United States Patent [19]

Greever et al.

[11] 4,197,800

[45] Apr. 15, 1980

[54] SINGLE CHAMBER RAP HAVING CENTERPORT INHIBITOR

[75] Inventors: Willis L. Greever, LaVale; Philip M. Stevens, Rawlings, both of Md.

[73] Assignee: Hercules Incorporated, Wilmington, Del.

[21] Appl. No.: 78,340

[22] Filed: Sep. 4, 1970

[51] Int. Cl.[2] ..... F42B 13/02

[52] U.S. Cl. ..... 102/38 RA; 102/49.3

[58] Field of Search ..... 102/49.3, 49.7, 38, 102/56, 67, 103; 60/365 RS

[56] References Cited

U.S. PATENT DOCUMENTS

| | | | |
|---|---|---|---|
| 2,434,652 | 1/1948 | Hickman | 102/49.7 X |
| 2,489,953 | 11/1949 | Burney | 60/35.6 RS |
| 2,987,388 | 6/1961 | Stanley | 102/103 |
| 3,117,044 | 1/1964 | Sauer | 149/92 X |
| 3,118,377 | 1/1964 | Davies et al. | 102/49.3 |
| 3,265,543 | 8/1966 | Carter | 149/19 |
| 3,389,026 | 6/1968 | Johnson | 149/92 X |
| 3,490,373 | 1/1970 | Fox | 102/64 |
| 3,493,446 | 2/1970 | Braun et al. | 102/103 |
| 3,572,249 | 3/1971 | Davis | 102/67 X |
| 3,578,520 | 5/1971 | Dolan et al. | 102/103 |
| 3,673,287 | 6/1972 | Thies et al. | 102/103 |
| 3,698,321 | 10/1972 | Wall | 102/103 |

*Primary Examiner*—Harold J. Tudor

*Attorney, Agent, or Firm*—Joshua W. Martin, III

[57] ABSTRACT

A rocket assisted projectile has a solid propellant charge within the projectile casing extending substantially throughout the length of the casing and has an inhibited centerport therein which axially extends substantially throughout the length of the propellant charge, and the solid propellant charge comprises a cast single explosive sensitized charge bonded to the casing and bonded to the inhibitor material of the inhibited centerport during cure of the cast charge with said charge having bifunctional characteristics to produce rocket thrust for the projectile in flight and high explosive blast of the projectile at target.

9 Claims, 1 Drawing Figure

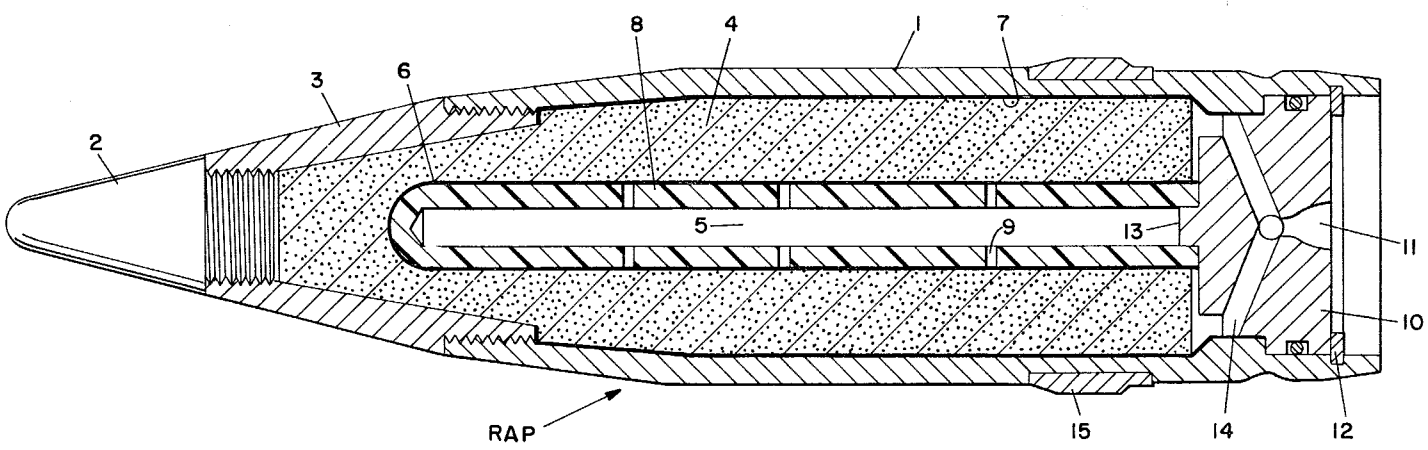
11
10
12
14
13
15
7
9
1
4
5
8
RAP
6
3
2

SINGLE CHAMBER RAP HAVING CENTERPORT INHIBITOR

This invention relates to projectiles and more particularly to rocket assisted projectiles (RAP) of the type capable of being launched from a gun or similar device.

RAP devices carry propellant to provide rocket thrust as well as an explosive charge to provide blast at the target. Normally in these devices the propellant and explosive are different materials and are contained in separate chambers of the projectile. More recently, however, RAP devices have been developed utilizing propellants which also can be detonated, and therefore such devices can perform both the required functions of thrust and blast and the propellant therefor can be contained in a single chamber in the projectile.

Generally, the invention includes novel means to provide for propellant centerport inhibition for the above described RAP devices wherein the inhibiting medium is cast in place during propellant cure. This is different from the normal means which involves bonding the inhibitor in place after propellant cure.

More particularly, the present invention comprises a rocket assisted projectile having in combination; a projectile casing; a solid propellant charge within the projectile casing extending substantially throughout the length of the casing and having an inhibited centerport therein which axially extends substantially throughout the length of the propellant charge; and the solid propellant charge being a cast single explosive sensitized charge bonded to the casing and bonded to the inhibitor material of the inhibited centerport during cure of the cast charge and said charge having bifunctional characteristics to produce rocket thrust for the projectile in flight and high explosive blast of the projectile at target.

A preferred embodiment of the invention has been chosen for purposes of illustration and description and is shown in the accompanying drawing which is a longitudinal axial sectional view depicting a RAP device in accordance with the invention.

In the drawing, a rocket assisted projectile (RAP) has a metallic casing 1, at the front end of which a point detonating fuze 2 or other type detonating device, is attached through a fuze adapter 3 thus forming an ogive. The casing 1 contains a solid propellant 4 disposed as a single homogeneous charge extending substantially throughout the length of the casing. The propellant 4 is formulated to have bifunctional characteristics. That is, from a rocket ballistic standpoint the propellant is formulated to deliver the thrust required for the projectile in flight and it is also formulated to deliver a high explosive blast at the target area. Such propellant formulations are readily attainable and readily detonatable by, for example, incorporating sufficient amounts of particulate RDX or other crystalline high explosives or nitroglycerin or other liquid nitric esters or combinations thereof in the propellant formulation. Preferably the propellant is of the composite modified double base (CMDB) type of which the following formulation is typical.

| PROPELLANT | |
|---|---|
| INGREDIENT | PERCENT |
| Plastisol Nitrocellulose (DuPont) | 14.5 |
| Nitroglycerin | 55.9 |
| Polyglycoladipate-toluenediisoycyanate adduct | 9.7 |

-continued

| PROPELLANT | |
|---|---|
| INGREDIENT | PERCENT |
| 2 Nitrodiphenylamine | 1.0 |
| RDX | 10.0 |
| Dinormalpropyladipate | 4.7 |
| Lead beta-resorcylate | 2.0 |
| Lead Silicylate | 2.0 |
| Carbon Black (Carbolac I) | 0.2 |
| Total | 100.0 |

The propellant charge or grain configuration depicted in the drawing was developed for a 40 mm RAP. This RAP was a case bonded cylindrical end burning charge. Since thermal and chemical shrinkage cause high stresses at the axial center of this grain configuration, a centerport 5 was required to provide stress relief. To preserve the end burning desired, the propellant surface in this centerport had to be inhibited. This was accomplished by providing a centerport inhibitor 6 which utilized the same chemical system which provides the case bond 7 for bonding the propellant 4 to the inner casing wall. In this chemical system a two layer case bonding composite is utilized. One layer as the substrate primer is applied next to the case and internal components and comprises a neoprene or vinyl chloride-vinyl acetate formulation which includes triphenyl-methane triisocyanate and which acts as a transitional bonding layer and as a barrier to plasticizer migration. The other layer as the propellant adhesive comprises a polyvinyl formal as the principal ingredient as well as a cross-linking agent such as titanium acetylacetone of 2,4-tolylene diisocyanate and which upon application bonds well to both the neoprene layer and the propellant.

Accordingly, with reference to the above, a metal casting core (not shown) was used to form the centerport. This core was coated with sufficient coats of neoprene solution to provide the desired thickness. A 0.005-inch-thick coating (dry) was found to provide inhibition in a 3.5-inch long—0.4-inch-diameter centerport for a hot propellant gas exposure time of over 5 seconds. The final neoprene coat was followed by a 0.001-inch-thick coat (dry) of polyvinyl formal in solution. Each coat of neoprene and the polyvinyl formal was applied by spraying which was found to be superior to brush coating although brush coating may be satisfactory in some functions. Drying was accomplished in a circulating air oven to remove the solvents and the inhibitor coated casting core was then ready for propellant casting.

The surfaces of the metal casting core were coated with Teflon to provide for a nonstick surface for ease of inhibitor separation from the core. The wet and dried coatings of neoprene had sufficient adhesion to the Teflon to maintain attachment of the inhibitor coating for placing in the projectile and until it was cured in the propellant. After propellant cure the chemical bond of the inhibitor to the propellant was sufficiently stronger than the inhibitor/Teflon adhesion bond to allow preferential parting at the inhibitor/Teflon interface. When this occured, the metal casting core was readily removable and the neoprene/polyvinyl formal "boot" was left behind, providing for the desired inhibited centerport 6.

A phenolic axial support rod 8 was then inserted into the centerport 5. The support rod 8 was hollow and had a plurality of bleed ports 9 positioned along its length to equalize the pressure generated by the rocket thrust interiorly and exteriorly of the rod 8. A one piece end closure 10 of steel (SAE 4130) having an axial nozzle 11 therein is affixed to the rearward end of the projectile and is held in place by a retaining ring 12. The end closure 10 has an inner protuberance 13 which firmly secures the end of the support rod 8 and it also has a plurality of four equally spaced ports 14 through which the end burning propellant 4 is initially ignited by propellant gases which are restricted by rifling ring 15 and which are used to launch the projectile. Since the propellant 4 is in communication with the axial nozzle 11 through the ports 14, upon burning of the propellant the gases issuing from the nozzle 11 provide the desired rocket thrust to the projectile.

It will be appreciated that the projectile flight is programmed so that sufficient propellant remains within the projectile to deliver desired and effective high explosive blast at the target area. Also, it will be appreciated that conventional materials of construction may be employed. This applies particularly to casings, fuzes and adapters, end closures including throat inserts, support rods and the like. The propellant, however, to deliver rocket thrust and to effect explosive blast is a propellant of the group consisting of double-base propellants, composite-modified double-base propellants and cross-linked propellants in which high explosive is present in an amount of from about 60% to about 80% by weight. The high explosive utilized is a material of the group consisting of liquid explosive nitric esters, crystalline high explosives of the organic or inorganic type, and mixtures thereof with nitroglycerin, cyclotrimethylene trinitramine (RDX) and cyclotetramethylene tetranitramine (HMX), being preferred materials. Compositions in which the inhibitor material for bonding the propellant to the casing and for inhibiting the propellant surface in contact with the support rod are disclosed in U.S. patent application Ser. No. 18,024, filed Feb. 26, 1970, to W. L. Greever.

What we claim and desire to protect by Letters Patent is:

1. A rocket assisted projectile having in combination:

(a) a projectile casing;

(b) a solid propellant charge within the projectile casing extending substantially throughout the length of the casing and having an inhibited centerport therein which axially extends substantially throughout the length of the propellant charge;

(c) said propellant charge being a cast single explosive sensitized charge selected from the group consisting of double base propellants, composite-modified double base propellants and cross-linked propellants in which high explosive is present in an amount of from about 60 to 80 weight percent, and said charge having bifunctional characteristics to produce rocket thrust for the projectile in flight and high explosive blast of the projectile at target;

(d) said propellant charge being chemically bonded to an inhibitor adjacent the casing inner wall and also to the inhibitor of the inhibited centerport by a chemical bonding system at each chemically bonded surface;

(e) said chemical bonding system at each said propellant surface being a two-layer composite including as a first layer an inhibitor material selected from the group of neoprene and a vinyl chloride-vinyl acetate/triphenylmethane triisocyanate formulation, and as a second layer a polyvinylformal together with a cross-linking agent therefor bonded both to said propellant and to said first layer; and (f) said inhibitor layer adjacent the inner casing wall bonded to said inner casing wall.

2. A projectile according to claim 1 wherein an axial support rod is positioned in the inhibited centerport to provide propellant support during high axial acceleration.

3. A projectile according to claim 2 wherein the surface of the propellant which contacts the axial support rod has the inhibitor material bonded thereto and the support rod is slidably positioned within the inhibited centerport.

4. A projectile according to claim 3 wherein the axial support rod is hollow and has bleed ports positioned along its length to equalize chamber pressure interiorly and exteriorly of the support rod.

5. A rocket assisted projectile of claim 1 including:

(a) a fuze affixed to the forward end of the projectile to form an ogive;

(b) an end closure and axial nozzle affixed to the rearward end of the projectile to direct rocket thrust;

(c) said solid propellant charge within the casing extending from adjacent the fuze to the end closure and being in communication with the axial nozzle; and (d) a hollow axial support member for said propellant extending within said inhibited centerport having its forward end adjacent the fuze and having its rearward end secured by the end closure, said member having bleed ports therein to equalize pressure of the rocket thrust interiorly and exteriorly of the support member.

6. A projectile according to claim 1 wherein the high explosive is a material of the group consisting of liquid explosive nitric esters, crystalline high explosives, and mixtures thereof.

7. A projectile according to claim 6 wherein the high explosive comprises nitroglycerin.

8. A projectile according to claim 6 wherein the high explosive comprises RDX.

9. A projectile according to claim 6 wherein the high explosive comprises HMX.

* * * * *